US006026998A

United States Patent [19]

Brooks

[11] Patent Number: 6,026,998

[45] Date of Patent: Feb. 22, 2000

[54] MULTIFLEX HANGERS

[76] Inventor: Alfonso Brooks, 449 A Paragonway, Greenfield, Ind. 46140

[21] Appl. No.: 09/257,479

[22] Filed: Feb. 25, 1999

[51] Int. Cl.[7] ..... A47G 25/40; A47G 25/14

[52] U.S. Cl. ..... 223/94; 223/89

[58] Field of Search ..... 223/89, 94, 85, 223/88, 92

[56] References Cited

U.S. PATENT DOCUMENTS

| | | | |
|---|---|---|---|
| 958,202 | 3/1910 | Klingenfeld | 223/94 |
| 2,425,527 | 8/1947 | Gaudino | 223/94 |
| 2,944,711 | 7/1960 | Sage | 223/94 |
| 3,430,827 | 3/1969 | Nelson | 223/94 |
| 4,126,252 | 11/1978 | Wasserman | 223/94 |
| 4,300,688 | 11/1981 | London et al. | 223/94 |
| 5,901,888 | 5/1999 | Schneider et al. | 223/94 |

*Primary Examiner*—Bibhu Mohanty
*Attorney, Agent, or Firm*—Patent & Trademark Services; Joseph H. McGlynn

[57] ABSTRACT

A hanger which has foldable side portions which can be folded around a garment to protect the garment from wrinkling while packed in a suitcase. In addition, the hanger has adjustable members to adjust the hanger to fit different size garments.

20 Claims, 1 Drawing Sheet

FIG. 1
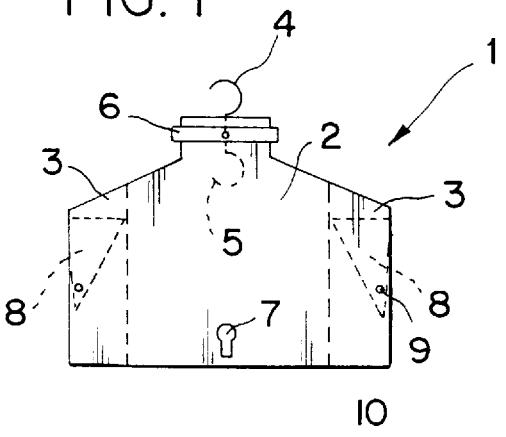
FIG. 2
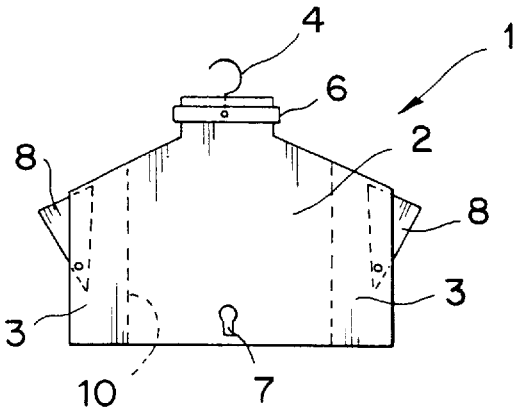
FIG. 3
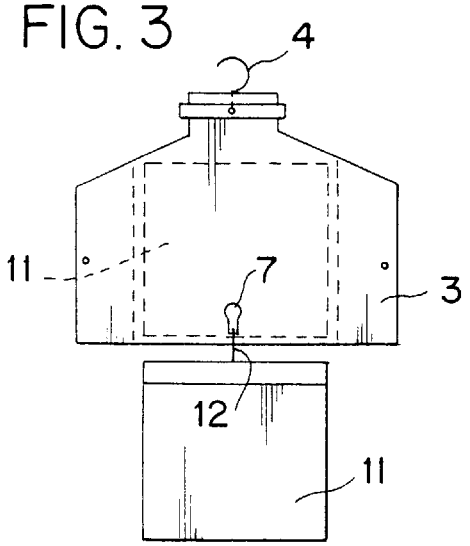
FIG. 4
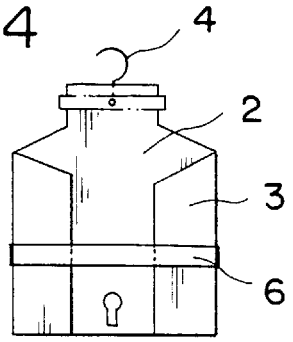
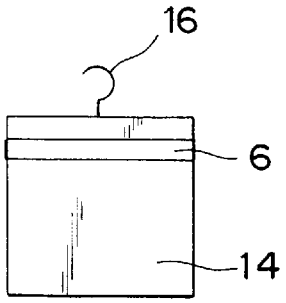
FIG. 5
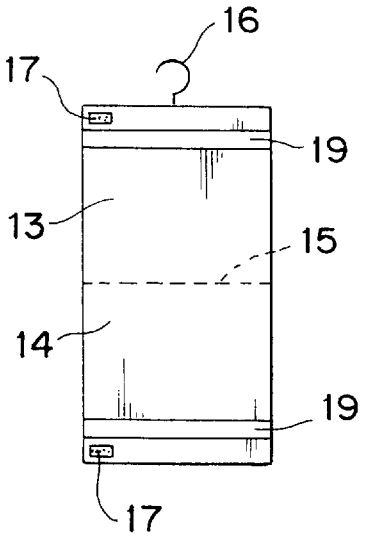
FIG. 6

MULTIFLEX HANGERS

BACKGROUND OF THE INVENTION

This invention relates, in general, to clothing protectors, and, in particular, to a hanger which will protect items such as shirts, sweaters and other garments while they are being transported in suitcases.

SUMMARY OF THE INVENTION

The present invention is directed to a hanger which has foldable side portions which can be folded around a garment to protect the garment by minimizing wrinkling while packed in a suitcase. In addition, the hanger has adjustable means, i.e. panel blades, pins, sliding rods, etc, to adjust the hanger to fit different size garments and to allow different fitting type garments to maintain their desired shapes.

It is an object of the present invention to provide a new and improved clothing hanger.

It is an object of the present invention to provide a new and improved clothing hanger that will lessen the wrinkles associated with packing clothes in a suitcase.

It is an object of the present invention to provide a new and improved clothing hanger that can be made inexpensively, but will be durable and will not take up an inordinate amount of packing space in a suitcase or other type of garment carrier.

These and other objects and advantages of the present invention will be fully apparent from the following description, when taken in connection with the annexed drawings.

BRIEF DESCRIPTION OF THE DRAWINGS

FIG. 1 is a plan view of the present invention.

FIG. 2 is a plan view of the present invention showing the adjustable means, i.e. panel blades, extended.

FIG. 3 is a plan view of the present invention showing the bottom portion attached to the top portion.

FIG. 4 is a plan view of the present invention showing the hanger in the closed or folded position.

FIG. 5 is a plan view of the bottom hanger of the present invention in a closed position.

FIG. 6 is a plan view of the bottom hanger of the present invention in an open position.

DESCRIPTION OF THE PREFERRED EMBODIMENT

Referring now to the drawings in greater detail, FIG. 1 shows a plan view of the hanger of the present invention. The hanger comprises a main or center portion 2 to which are attached two side portions 3. The side portions 3 can be attached to the main portion 2 by fold lines 10, as shown in FIG. 1, however, this is not the only method that can be used for attaching the side portions to the center portion. For example, hooks or other mechanical fasteners could be used which would allow the side portions 3 to be moved from the position shown in FIG. 1 to the position shown in FIG. 4, wherein the side portions 3 overlap the main portion 2.

The main portion 2 also has a keyhole or slot 7 positioned near the bottom of the main portion which can be used to secure the portion 11, as shown in FIG. 3, or the hook 16 on the hanger portion 13, 14, shown in FIG. 5. The main portion 2 also has a pivoting hook 4 which can be pivoted or slid from the solid line position shown in FIG. 1 to the dotted line position 5, also shown in FIG. 1. This pivoting action will allow the hook to be used in the normal manner once the traveler reaches his destination, and it also allows the hook to be pivoted or slid out of the way, to the dotted line position 5 when the hanger is placed in a suitcase or other garment carrier. The exact mechanism which allows the hook 4 to be pivoted or slid from the solid line position to the dotted line position can be any conventional pivoting or sliding mechanism (i.e. a mechanism which allows the hook to be pulled up and pushed down our of the way), therefore, no further description of the mechanism is necessary.

As shown more clearly in FIG. 2, each side portion 3 has an adjustable means, i.e. panel blades, pins, sliding rods, etc, 8 attached thereto. The adjustable means 8 are attached to the side portions 3 by any conventional mechanism 9, such as, but not limited to, rivets which will allow the adjustable means 8 to move from the closed position shown by the dotted lines in FIG. 1 to the open position shown in FIG. 2. The adjustable means 8 allow the hanger to adjust to prevent any garment secured to the hanger 1 from sticking out beyond or being stretched out of proportion. This will prevent the shoulder or upper portion of the garment and the lower portion of the garment from extending beyond the hanger and becoming wrinkled or disproportionate.

In use, a traveler would place a garment, such as a shirt or blouse, on the main portion 2 of the hanger 1. Then he/she would fold the side pieces 3 over the shirt or blouse and secure it in position with the elastic means 6 (shown in its stored position in FIG. 1 and in its in use position in FIG. 4). This would secure the garment in place and prevent most wrinkles while the garment is packed in a suit case. The hook 4 can be pivoted or slid to the dotted line position 5 while the hanger and the attached garment are in the suitcase, and can be pivoted or slid to the solid line position when the traveler reaches his/her destination and wants to hang the garment in a closet.

While the hanger of the present invention will prevent the majority of wrinkles while traveling, if any wrinkles are found in the garment, the traveler can open up the sides 3, place the hanger on a horizontal surface, such as a bed, and use an iron to smooth out any wrinkles. The main portion 2 and the side portions 3 would act as an ironing board and make this task easier.

As shown in FIG. 3, a bottom portion can be attached to the main hanger portion 2 by a hook 12, or any other conventional fastener, which would be secured to the bottom portion 11 and which would engage the keyhole or slot 7 adjacent the bottom the of the main portion 2. The bottom portion could be pivoted up onto the main portion 2, either before or after the side portion 3 are folded unto the main portion 2. This would provide additional support for the garment secured to the hanger 1 and help prevent wrinkles.

As shown in FIG. 5, the hanger 1 can include a bottom hanger, which can be used by itself or in conjunction with the hanger 1. The bottom hanger will have a hanging hook 16 attached to the top of the hanger in any conventional manner and will be used to hang the bottom hanger on a closet rod or can be used to attach the bottom hanger to the hanger 1 by passing the hook 16 through the slot 7. The bottom hanger will have basically two portions 13 and 14 which can be secured together in the same manner as the main portion 2 and the side portions 3 of the hanger 1. The preferred method is to provide a fold line 15 which will allow the portion 14 to be folded onto the portion 13.

Each portion 13, 14 will have a securing means 17 which could take the form of magnets or VELCRO hook and loop type fasteners, which will hold the portion 14 securely to the portion 13 when the bottom hanger is closed, as shown in FIG. 5. In addition, the portions 13 or 14 will have a clamp 19 which will assist in holding a garment between or on the portions 13, 14. The clamps 19, as shown in FIG. 6 are essentially projections attached either integrally or unitarily to the portions 13 or 14 and will "pinch" the garment (i.e. pants, skirt, dress, etc) when the portion 14 is folded over the portion 13 and secured thereto by the elastic means 17.

It should be noted that the clamps 19 are shown as being positioned adjacent the top of the portion 13 and adjacent the bottom of the portion 14, however, this is merely for illustrational purposes. The clamp 19 near the top of portion 13 could be positioned near the bottom of portion 13, and the clamp 19 on portion 14 could be positioned near the top of 14. Also, clamps could be positioned at both the top and bottom of portions 13, 14, and even positioned at other locations such as in the middle of the portions 13, 14, with out departing from the scope of the invention. Also, the clamps 19 could be positioned vertically along the portions 13, 14 instead of horizontally, as shown in FIG. 6.

In addition, other modifications could be made to the bottom hanger. For example, other clamping means, other than the clamps 19 could be used. Also, the bottom hanger could be formed so that the clothes could be slipped into place onto the hanger while in an already folded position. That is, the garment could be placed into the bottom portion of the hanger in a folded position which is the same position that the clothes would be placed on a conventional hanger.

In use, a traveler would place a garment on the portion 13 and then fold over the portion 14 to overlie the garment and the portion 13. The clamps 19 would "pinch" the garment between the two portions to prevent it from slipping out, and the fasteners 17 along with the elastic means 6 would secure the two portions 13, 14 together. In this manner a traveler could pack a garment in a suit case or garment carrier and they would arrive at their destination essentially wrinkle free. The hook 16 could be used to hang the entire bottom hanger in a closet when the traveler reaches his/her destination, and the portion 13 could be used as an ironing board in the unlikely case that the garment contained some minor wrinkles when the traveler arrives at his/her destination.

Although the Multiflex Hangers and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A hanger comprising:

a main portion, said main portion having a top, bottom and sides, at least one side portion movably attached to at least one of said main portion sides, said at least one side portion being movable from a first position to a second position, said at least one side portion when in said second position overlying a portion of said main portion, means attached adjacent said top of said main portion for hanging said hanger, and means adjacent said bottom of said main portion for securing an additional hanger, and wherein there are two side portions, each one of said two side portions being movably secured to one of said main portion sides, each one of said two side portions being movable from a first position to a second position, each one of said two side portions when in said second position overlying a portion of said main portion, and wherein said hanger has means for securing said two side portions in said second position, and wherein said means for securing said two side portions in said second position is at least one elastic band.

2. The hanger as claimed in claim 1, wherein said means adjacent said bottom of said main portion is a slot.

3. The hanger as claimed in claim 2, wherein said slot is a keyhole slot.

4. The hanger as claimed in claim 1, wherein said at least one side portion has an extension portion attached thereto, p1 said extension portion being movable from a first position to a second position, and in said first position, said extension portion has a side portion which is essentially coextensive with a side of said side portion, and in said second position, said extension portion has a side portion which extends beyond said side of said side portion.

5. The garment hanger as claimed in claim 4, wherein said means for holding said additional hanger in said second position is a pair of magnets.

6. The garment hanger as claimed in claim 4, wherein said means for holding said second portion in said additional hanger is VELCRO.

7. The garment hanger as claimed in claim 6, wherein said clamping means is at least one projection on said maid portion or said additional hanger.

8. The hanger as claimed in claim 1, wherein said main portion has a bottom portion attached thereto, said bottom portion being secured adjacent to said bottom of said main portion, said bottom portion being movable from a first position to a second position, and in said first position, said bottom portion is essentially coplanar with said main portion, and in said second position, said bottom portion overlies said main portion.

9. The hanger as claimed in claim 1, in combination with an additional hanger, said additional hanger comprising:

means for attaching said additional hanger to said means adjacent said bottom of said main portion, said additional hanger being movably secured to said main portion, said additional hanger being movable from a first position to a second position, and in said first position, said additional hanger is approximately coplanar with said main portion, and in said second position, said additional hanger overlies said main portion, means for holding said additional hanger in said second position.

10. The hanger as claimed in claim 4, wherein said means for hanging said hanger is a hook.

11. The hanger as claimed in claim 4, wherein said main portion and said additional hanger have clamping means and an elastic means for securing an article of clothing between said main portion and said additional hanger.

12. A hanger comprising:

a main portion, said main portion having a top, bottom and sides, at least one side portion movably attached to at least one of said main portion sides, said at least one side portion being pivotably attached adjacent a bottom portion of said at least one side portion to said main portion, said at least one side portion being pivotable from a first position to a second position, said at least one side portion, when in said first position, extending in a plane which is contained within said top, bottom and sides of said main portion, said at least one side portion, when in said second position, having portions which extend in a plane which is contained within said top, bottom and sides of said main portion, and also having a portion which extend in a plane which is not contained within said top, bottom and sides of said main portion, means attached adjacent said top of said main portion for hanging said hanger, and means adjacent said bottom of said main portion for securing an additional hanger.

13. The hanger as claimed in claim 9, wherein said means adjacent said bottom of said main portion is a slot.

14. The hanger as claimed in claim 13, wherein said slot is a keyhole slot.

15. The hanger as claimed in claim 12, in combination with an additional hanger, said additional hanger comprising:

means for attaching said additional hanger to said means adjacent said bottom of said main portion, said additional hanger being movably secured to said main portion, said additional hanger being movable from a first position to a second position, and in said first position, said additional hanger is approximately coplanar with said main portion, and in said second position, said additional hanger overlies said main portion, means for holding said additional hanger in said second position.

16. The hanger as claimed in claim 12, wherein said means for hanging said hanger is a hook.

17. The garment hanger as claimed in claim 12, wherein said means for holding said additional hanger in said second position is a pair of magnets.

18. The garment hanger as claimed in claim 12, wherein said means for holding said additional hanger in said second position is VELCRO.

19. The hanger as claimed in claim 12, wherein said main portion and said additional hanger have clamping means and an elastic means for securing an article of clothing between said main portion and said additional hanger.

20. The garment hanger as claimed in claim 12, wherein said clamping means is at least one projection on said main portion or said additional hanger.

* * * * *